US007950097B2

(12) United States Patent
Damrath et al.

(10) Patent No.: US 7,950,097 B2
(45) Date of Patent: May 31, 2011

(54) CLEANING APPARATUS FOR A PREFERABLY PLANAR SURFACE

(75) Inventors: Joachim Damrath, Bachhagel (DE); Stefan Holzer, Aalen (DE); Martin Neumayer, Gerstetten (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 190 days.

(21) Appl. No.: 12/374,497

(22) PCT Filed: Jul. 12, 2007

(86) PCT No.: PCT/EP2007/057160

§ 371 (c)(1),
(2), (4) Date: May 14, 2009

(87) PCT Pub. No.: WO2008/009614

PCT Pub. Date: Jan. 24, 2008

(65) Prior Publication Data

US 2010/0005606 A1 Jan. 14, 2010

(30) Foreign Application Priority Data

Jul. 20, 2006 (DE) ..... 10 2006 033 669

(51) Int. Cl.
*A47L 1/02* (2006.01)

(52) U.S. Cl. ..... 15/97.1; 15/49.1; 15/98; 15/103; 15/422.2; 15/340.1; 15/403

(58) Field of Classification Search ..... 15/51, 52, 15/49.1, 97.1, 98, 103, 403, 422.2, 340.1; *A47L 1/02*
See application file for complete search history.

(56) References Cited

FOREIGN PATENT DOCUMENTS

| | | |
|---|---|---|
| DE | 100020503 | * 10/2001 |
| JP | 11171063 | * 6/1999 |
| WO | WO03/013944 | * 2/2003 |

* cited by examiner

*Primary Examiner* — David A Redding
(74) *Attorney, Agent, or Firm* — Laurence A. Greenberg; Werner H. Stemer; Ralph E. Locher

(57) ABSTRACT

A cleaning apparatus is provided for a preferably planar surface, in particular a window pane, and has a wiping device and a plunger which keeps the wiping device in contact with the surface and also, by way of an open side, bears against the surface and seals it around the edge. A suction device generates a negative pressure in the plunger. The plunger is provided with driving rollers, which are actuated by motor, for moving the plunger together with the wiping device. The suction device has at least two fans which are each provided with their own outlet opening.

5 Claims, 3 Drawing Sheets

CLEANING APPARATUS FOR A PREFERABLY PLANAR SURFACE

BACKGROUND OF THE INVENTION

Field of the Invention

The invention relates to a cleaning apparatus for a preferably planar surface, in particular a window pane, with a wiping device and a suction bell which keeps the wiping device in contact with the surface, said suction bell likewise resting with an open side on the surface in a sealing manner around the edge thereof, and also a suction device for generating a negative pressure in the suction bell.

A cleaning apparatus of this type must, particularly if it is to operate in the manner of a so-called autonomous window cleaner, be reliably held against the surface to be cleaned, which requires a sufficiently high adhesive force. To generate the adhesive force, a negative pressure is generated in at least one space positioned between the surface and the cleaning apparatus. A force with which the cleaning apparatus is pushed onto the surface is produced as a product from the difference between the negative pressure and the normal pressure in the surroundings of the cleaning apparatus on the one hand and the surface content of the area (or areas, if several are present) of the surface, at which the negative pressure is present, on the other hand. To generate a desired force, an adequately large surface area is thus required in the case of lower negative pressure while a lower surface area is sufficient in the case of greater negative pressure.

Reference is made to documents EP 1 237 456 B1 and U.S. Pat. No. 6,691,811, WO 01/80703 A1, DE 100 65 405 A1, WO 2005/093536 A1 and WO 2005/093537 A1 in respect of the prior art. The contents of these documents are to be fully attributed to the present disclosure. A cleaning apparatus is disclosed in each of these documents, which essentially uses the overall area which is covered by the surface to be processed to form the space to be exposed to negative pressure. The negative pressure to be generated may thus be comparatively minimal and may be generated with a correspondingly designed fan or ventilator. The advantage of this design is that leakages in the structure of the cleaning apparatus and leakages which result due to unevennesses on the surface, only have a slight influence. In particular, this cleaning apparatus may move across a vertical surface, which is covered in the usual manner with tiles with recessed gaps left between two tiles in each instance, without impairing the adhesion. Forces between the seals on the cleaning apparatus, which delimit the space to be exposed to the negative pressure, and the surface are comparatively minimal; this apparatus can thus move across the surface with comparatively moderate friction. The part of the apparatus which has to be exposed to the negative pressure is thus called a "suction bell."

An apparatus is described in WO 03/013944 A2, which uses a plurality of small suckers instead of a suction bell of the described type, in order to hold the apparatus on the surface to be traversed. A relatively good vacuum has to be generated in each instance in the spaces delimited by these suckers and the surface in order to hold the apparatus securely on the surface. Vacuum pumps are provided in order to generate the corresponding vacuums, said pumps also having redundancy in order to prove a measured operational reliability. Whether the high forces between the suckers and the surface permit as a matter of principle displacements of the suckers and the overall apparatus across the surface remains open or needs to be the subject matter of further development in the case of realization.

BRIEF SUMMARY OF THE INVENTION

The object underlying the invention is thus to embody a cleaning apparatus of the type mentioned in the introduction such that it can achieve an adequate adhesive force on the surface to be cleaned with as little effort as possible, whereby a high fault tolerance is also to be achieved, in other words, no negative effects are to occur if the cleaning apparatus traverses contamination or unevenness on the surface to be cleaned or if a resource in the cleaning apparatus should fail.

This object is achieved in accordance with the invention such that the suction bell is provided with motor-actuated driver rollers for moving the suction bell with the wiping device and the suction bell has at least two ventilators with an outlet opening assigned thereto in each instance.

An advantage achieved by the invention essentially consists in a relatively simply structured and thus safely and reliably operating device initially being created, with the suction device achieving a high degree of efficiency.

To further enable the moveability of the cleaning apparatus during autonomous operation, it is provided with a suction bell of the type defined in the introduction, which has a relatively large contact area with the surface to be processed and manages accordingly with a relatively minimal negative pressure. The motor-actuated drive rollers needed for the autonomous movement belong to the suction bell, and are thus positioned in an interior of the suction bell. To achieve as reliable an operation as possible, provision is made within the scope of the invention for the suction bell to have two ventilators with an outlet opening assigned thereto in each instance. This is advantageous in that the adhesion of the apparatus to the surface to be processed is then also not jeopardized if one of these ventilators fails.

In a first preferred embodiment, these ventilators operate in the manner of a parallel circuit, thereby still ensuring an at least limited maintenance of operation, particularly in the case of a corresponding dimensioning, if one of the ventilators fails. To this end, it is preferable within the scope of the invention for the outlet openings to be provided with a sealing cover in each instance. In the event of the already addressed failure of one of the ventilators, this stops air from being sucked in by the ventilator which is still operating via the outlet opening of the failed ventilator. The sealing covers are also advantageously closed in idle mode in the manner of a valve. This can take place in the case of a suitable mounting by way of gravity; however there is an embodiment, preferably within the scope of the invention, with which the sealing covers are held in their closed position by means of spring elements. It is not absolutely necessary for a sealing cover to seal the assigned outlet opening in a leak-proof fashion; it is only necessary for the sealing cover to limit the additional air flow in the outlet opening to such a degree that the negative pressure can be adequately maintained.

According to a second preferred embodiment of the invention, provision is made for the suction bell to have two or more ventilators, which are connected to one another in series, with the outlet of the first ventilator being connected to the inlet of the second ventilator and the last of the ventilators opening into the outlet opening for expelling air from the suction bell. With this series connection, a considerably lower negative pressure can firstly be achieved in the suction bell, since, in any case theoretically, the achievable negative pressure doubles with each stage.

Also in the case of this arrangement of the ventilators, if a ventilator fails, a redundant mode of operation results, since a still functioning ventilator still always applies adequate suction force, in order to generate the negative pressure needed for the necessary adhesive force. It is preferably at least possible with this mode of operation for the cleaning apparatus to move into a secure park situation in an "emergency program", with a still active ventilator already sucking the air out through the impeller of the inactive ventilator. Furthermore, this arrangement is advantageous in that only one outlet opening is present, and no sealing cover is necessary.

To achieve an adequate seal around the edge of the suction bell, provision is made within the scope of the invention for the suction bell to be provided with a sealing skirt arranged around the edge.

The wiping device of the cleaning apparatus can be selected here according to the requirements; a preferred embodiment consists in the suction bell being embodied in the manner of a rectangle and the wiping device being formed with a wiping strip arranged around the edge in parallel to the suction bell.

Exemplary embodiments of the invention are described in more detail below with reference to the drawing, in which;

DESCRIPTION OF THE INVENTION

Figure 1:
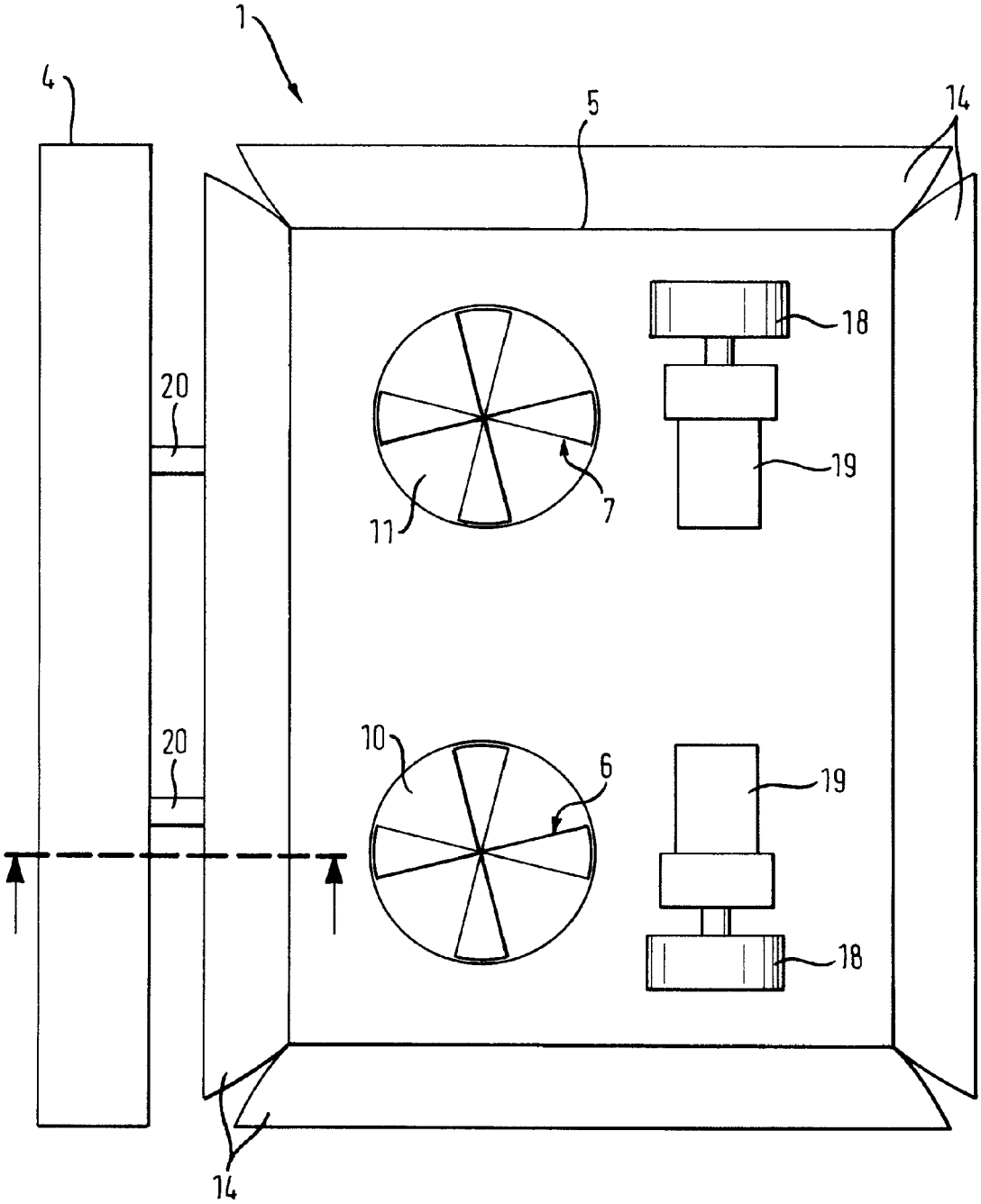
FIG. 1 shows a schematic view from below of a first exemplary embodiment.

Reference is made in the following description to all three figures in each instance, if nothing else is indicated and the context requires nothing else.

Each cleaning apparatus 1 (cf. FIGS. 2 and 3) is provided for use on a planar, vertically standing surface 2 of a particularly vertically positioned window pane 3, with a mode of operation in particular being considered as an autonomous window cleaner. To this end, the cleaning apparatus 1 is provided with a wiping device 4 and a suction bell which keeps the wiping device 4 in contact with the surface 2 to be cleaned, said suction bell resting with an open side on the surface 2 to be cleaned, in a sealed manner around the edge. To keep the suction bell 5 in contact with the surface 2 to be cleaned, a suction device 6, 7, 8, 9 is provided to generate a negative pressure in the suction bell 5. The suction bell 5 is connected to the wiping device 4 by way of two in particular moveable arms 6.

It is not to be assumed that the three figures of the drawing show all necessary features and components of a real cleaning apparatus 1; it should instead be noted that only the features and components necessary for the present description are displayed in the Figures and considered in the text below.

Figure 2:
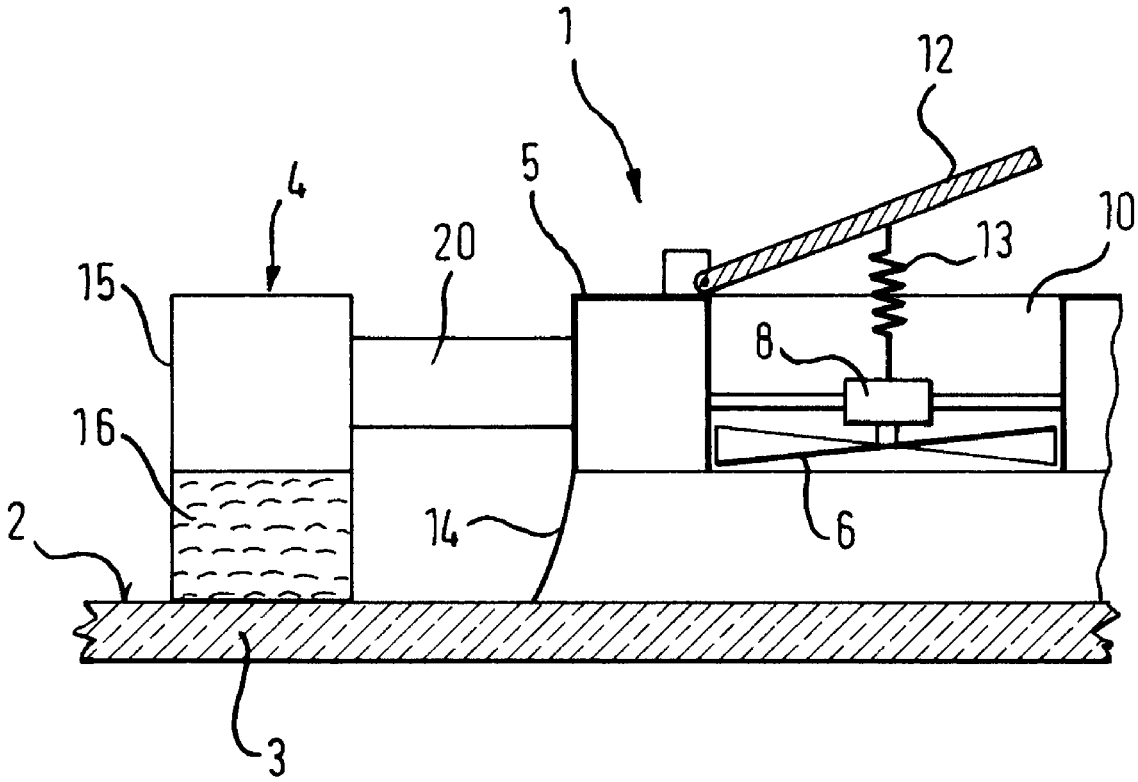
FIG. 2 shows a cross-sectional view of the same exemplary embodiment, as viewed in the direction of the arrows along the dashed line in FIG. 1.

In the first exemplary embodiment according to FIGS. 1 and 2, this suction device 6, 7, 8, 9 is formed from at least two ventilators 6, 7 arranged in and/or on the suction bell 5, which suck air out of the suction bell 5 and expel it by way of assigned outlet openings 10 and/or 11 on the suction bell 5.

The two ventilators 6 and 7 in particular offer an increased fail safety, since, with suitable dimensioning, ventilator 6 or 7 at least ensure that the cleaning apparatus 1 can be moved into a safe park position with the aid of an "emergency program". It is however certainly necessary for the outlet openings 10, 11 to be provided with sealing covers 12 (only one is shown in FIG. 2), which are closed in idle mode in the manner of a valve, since the still active ventilator 6 or 7 would otherwise suck air in via the outlet opening 11 or 10 of the failed ventilator 7 or 6. To this end, the sealing covers 12 are loaded with spring elements 13; according to FIG. 2, the spring element acts upon the motor 8 of the ventilator 6 which is fixedly connected to the suction bell 5.

Figure 3:
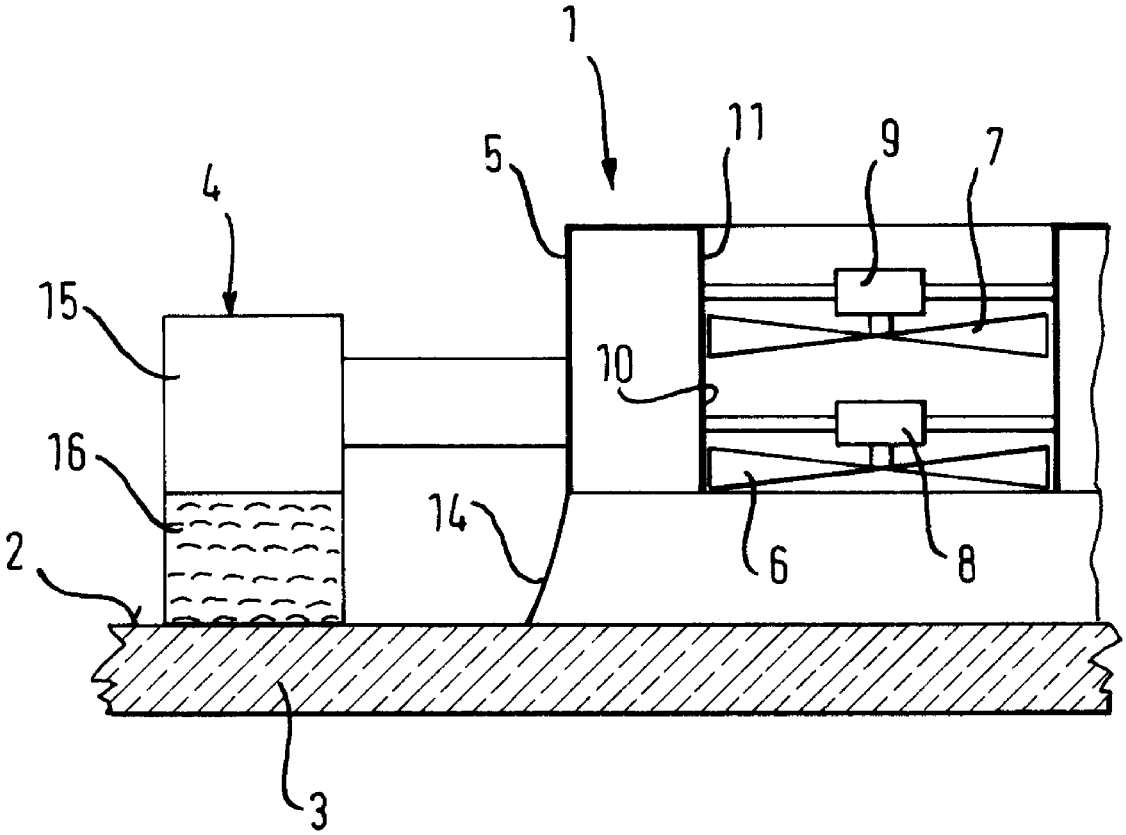
FIG. 3 shows a cross-sectional view of a second exemplary embodiment.

Since sealing covers 12 of this type represent an additional outlay, a second embodiment is recommended, as shown in FIG. 3. The suction bell 2 likewise comprises two (or even more) ventilators 6 and 7, which are connected to one another in series, with the outlet of the first ventilator 6 being connected to the inlet of the second ventilator 7. The second ventilator 7 then opens into the only outlet opening 10 present.

A view from below of this second embodiment according to FIG. 1 can be imagined such that only one single ventilator 6, positioned approximately centrally in the suction bell 5, could be seen instead of the two ventilators 6 and 7.

The second embodiment is initially advantageous in that a lower negative pressure and thus better adhesion to the surface to be cleaned can be achieved in the suction bell 5, since, at least theroretically, the achievable negative pressure doubles with each additional ventilator 7. High reliability also applies here, since, in the case of a ventilator 6, 7 failing, the additional ventilator 7 or 6 can suck air in through the then inactive ventilator 6 and/or 7, so that the only result is a drop in the negative pressure occurring in the suction bell 5. The previously described possibility of moving the cleaning apparatus 1 into a secure park position also exists here.

Incidentally, the suction bell 5 is provided with a divided sealing skirt 14 arranged around the edge, thereby ensuring a seal with the surface 2 to be cleaned.

Drive rollers which are actuated by way of motors 19 are also shown in the drawing, these being provided to move the suction bell 5 together with the wiping device 4. The two drive rollers 18 shown here are to be seen as representatives of an optionally larger number of drive rollers 18 with or without an assigned motor drive, depending on the application purpose and the design of the cleaning apparatus 1. The suction bell 5 is so large that it covers the drive rollers 18, and/or that the drive rollers 18 are arranged in its interior. In this way, the area of the surface 2 which can be exposed to negative pressure is maximized, thereby also advantageously increasing the operating reliability of the cleaning apparatus 1.

The described arrangements of the ventilators 6 and 7 can basically be used in the case of any type of suction bell 5; the suction bell 5 is however, as shown in FIG. 1, preferably embodied like a rectangle, with it being possible for the wiping device 4 to be formed of a wiping strip 15 arranged around the edge in parallel to the suction bell 5 with a porous wiping element 16 arranged thereupon, making contact with the surface and absorbing cleaning fluid and dirt detaching from the surface 2. However, any other type and design of a wiping device 4 is basically also conceivable here.

The invention claimed is:

1. A cleaning apparatus for cleaning a surface, the cleaning apparatus comprising:

a wiping device;

a plunger disposed to maintain said wiping device in contact with the surface to be cleaned, said plunger having an open side resting on and sealed against the surface;

a suction device for generating a vacuum in said plunger, said suction device including a first ventilator having a first outlet opening, a second ventilator disposed in series with said first outlet opening and having a second outlet opening formed to expel air from said plunger; and motor-actuated drive rollers for moving said plunger and said wiping device.

2. The cleaning apparatus according to claim 1, configured for cleaning a planar surface.

3. The cleaning apparatus according to claim 1, configured for cleaning a window pane.

4. The cleaning apparatus according to claim 1, wherein said plunger is formed with sealing skirts extending arranged around an edge on the open side thereof.

5. The cleaning apparatus according to claim 1, wherein said plunger is formed with a rectangular outline and said wiping device is formed with a wiping strip disposed adjacent and parallel to an edge of said plunger.

* * * * *